US008601836B2

(12) United States Patent
Kim et al.

(10) Patent No.: US 8,601,836 B2
(45) Date of Patent: Dec. 10, 2013

(54) LAUNDRY TREATMENT MACHINE AND THE METHOD OF THE SAME

(75) Inventors: Youngjong Kim, Changwon-si (KR); Jimaeng Kim, Changwon-si (KR); Yongkeon Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 502 days.

(21) Appl. No.: 12/847,560

(22) Filed: Jul. 30, 2010

(65) Prior Publication Data

US 2011/0047714 A1 Mar. 3, 2011

Related U.S. Application Data

(60) Provisional application No. 61/230,622, filed on Jul. 31, 2009.

(30) Foreign Application Priority Data

Jul. 31, 2009 (KR) ..... 10-2009-0071041
Dec. 4, 2009 (KR) ..... 10-2009-0119999
Dec. 4, 2009 (KR) ..... 10-2009-0120001

(51) Int. Cl.
*D06F 39/10* (2006.01)

(52) U.S. Cl.
USPC ..... 68/18 F; 68/23.4

(58) Field of Classification Search
USPC ..... 68/18 F, 23.4, 23.5, 207, 235 R, 237; 210/167.01, 167.31, 196, 238, 380.2, 210/346
See application file for complete search history.

(56) References Cited

U.S. PATENT DOCUMENTS 5,509,283 A * 4/1996 Lee et al. ..... 68/18 F
5,661,989 A * 9/1997 Jeon et al. ..... 68/18 F
5,849,182 A * 12/1998 Shin ..... 210/167.01
5,858,220 A * 1/1999 Shin ..... 210/167.01
5,931,027 A * 8/1999 Shin ..... 68/18 F
5,931,028 A * 8/1999 Shin et al. ..... 68/18 F
5,989,418 A * 11/1999 Shin ..... 210/167.01
2008/0196452 A1* 8/2008 Bae et al. ..... 68/18 F
2008/0216518 A1* 9/2008 Yoo et al. ..... 68/12.13
2008/0216519 A1* 9/2008 Yoo et al. ..... 68/12.13
2008/0216523 A1* 9/2008 Yoo et al. ..... 68/212
2008/0217243 A1* 9/2008 Yoo et al. ..... 210/636

FOREIGN PATENT DOCUMENTS

WO WO 2005118940 A1 * 12/2005 ..... D06F 39/10

* cited by examiner

*Primary Examiner* — Joseph L Perrin
(74) *Attorney, Agent, or Firm* — Birch, Stewart, Kolasch & Birch, LLP

(57) ABSTRACT

A lint filter in a laundry treatment machine includes a lower filter for filtering out debris of washing water and an upper filter for collecting debris as well as filtering out foreign substances of washing water flowed in from the lower filter. Since debris is collected in the upper filter, recontamination by debris can be prevented and cleaning of a lint filter can be simplified. The upper filter and the lower filter are connected by a connection path and as washing water and debris in the lower filter move to the upper filter at the time rising water flows of washing water are generated, debris can be collected inside the upper filter, and debris can be collected by using rising flows of washing water. A filter cover is combined with a filter frame and a filter body as a tightly coupled single body, and the filter cover is detached only from the filter frame while tightly coupled with the filter body, so that attaching and detaching is made simple and cleaning thereof can be simplified.

7 Claims, 17 Drawing Sheets

LAUNDRY TREATMENT MACHINE AND THE METHOD OF THE SAME

CROSS REFERENCE TO RELATED APPLICATIONS

This nonprovisional application claims the benefit of U.S. Provisional Application No. 61/230,622 filed on Jul. 31, 2009 and to Patent Application Nos. 10-2009-0071041, 10-2009-0119999 and 10-2009-0120001 filed in Republic of Korea, on Jul. 31, 2009, Dec. 4, 2009 and Dec. 4, 2009 respectively. The entire contents of all of the above applications are hereby incorporated by reference into the present application.

BACKGROUND OF THE INVENTION

1. Field of the Invention

The present invention is related to a laundry treatment machine and the method of the same. More specifically, the present invention is related to a laundry treatment machine and the method of the same which includes a lint filter capable of filtering out debris of washing water effectively and is easy to clean.

2. Description of the Conventional Art

In general, various devices such as a washing machine for removing contamination of clothes, bedclothes, and the like (referred to as 'fabric' afterwards) by using water, a detergent, and a mechanical operation; a drying machine for drying wet fabric by using dry, hot wind heated by a heater and a mechanical operation; a washing machine with drying capable of both washing and drying; and a refresher for preventing allergy due to fabric by spraying heated steam on the laundry which process fabric by applying a physical and a chemical operation to the fabric are collectively known as a laundry treatment machine.

The laundry treatment machine can be classified into a top-loading type laundry treatment machine where a fabric entrance hole through which fabric is put in and taken out is formed on the top surface of a cabinet and washing is carried out by rotating water flows generated from rotation of a washing tub; and a drum type laundry treatment machine where a fabric entrance hole is formed in the front of a cabinet and washing is carried out by drop of the laundry during rotation of a drum.

A conventional top loading type laundry treatment machine comprises a cabinet which forms an external appearance and whose top surface has an opening; a base installed in the bottom of the cabinet; an outer tub which is installed inside the cabinet and stores water; a washing tub which is installed inside the outer tub and performs washing of fabric; a driving apparatus including a motor which is disposed in the bottom of the washing tub and rotates the washing tub; a water supply apparatus supplying water into the outer tub; and a draining apparatus for draining water inside the outer tub. Also, a lint filter for filtering out debris is installed in the washing tub.

In the bottom surface of a conventional lint filter, an inlet is formed through which washing water flows in and an outlet is formed in the upper side through which washing water flows out, debris of which has been filtered out while passing through the lint filter.

In a conventional laundry treatment machine as described above, during a washing course, water flows generated by the pulsator flow in through the bottom of the lint filter and go up and then are discharged to the washing tub after passing through the lint filter.

Since only the water flows rising along the wall of the washing tub are flowed in through the bottom of the lint filter in a conventional laundry treatment machine, capacity for washing water flowing into the lint filter is limited and thus, filtering efficiency is low. In addition, attaching and detaching of the lint filter is complicated, causing a cleaning problem.

SUMMARY OF THE INVENTION

An object of the present invention is to provide a laundry treatment machine and a method for controlling the same which improves filtering efficiency of a lint filter installed at an inner wall of a washing tub and allows easy cleaning.

A laundry treatment machine according to the present invention comprises a case including a fabric entrance hole on a top surface thereof and a washing tub disposed to be able to rotate inside the case, and a lint filter disposed at an inner wall of the washing tub and filtering out debris of washing water. The lint filter comprises a lower filter including a lower side entrance to allow washing water rotating along circumferential direction of the washing tub to flow through the side and filtering out debris of washing water flowed in through the lower side entrance, and an upper filter disposed in the upper side of the lower filter and opened into the lower filter in a vertical direction and allowing washing water risen from the lower filter to flow in when rising water flow are generated by the rotation of the washing tub and forming a collecting space for collecting debris of the washing water.

In the present invention, at least a part of a connecting path connecting the upper filter and the lower filter has a reduced part whose cross section is smaller then that of the remaining part.

In the present invention, the washing water is discharged through the front in the upper filter and the upper filter is more protruded to the front than the lower filter.

In the present invention, wherein the lint filter further comprises an upper side entrance formed to allow washing water rotating in the circumferential direction of the washing tub to flow in the upper filter.

In the present invention, the size of the upper side entrance is smaller than the size of the lower side entrance.

In the present invention, wherein the upper filter and the lower filter respectively include a mesh part and mesh holes of the mesh part of the upper filter are formed to be smaller than those of the mesh part of the lower filter.

In the present invention, wherein a check valve is further included, the check valve being disposed at the lower side entrance with opening and closing in the lateral direction and preventing washing water flowed into the lower filter from flowing backward to the outside.

In the present invention, wherein a check valve is further included, the check valve being disposed at the upper side entrance with opening and closing in the lateral direction and preventing washing water flowed into the upper filter from flowing backward to the outside.

In the present invention, further includes a filter is disposed at the front of the upper filter and connected to the upper filter and the lower filter and the filter frame is fixed in the inner wall of the washing tub and supporting the lower filter.

A laundry treatment machine according to another aspect of the present invention a case including a fabric entrance hole on a top surface thereof, and a washing tub disposed to be able to rotate in the case, and a lint filter disposed at an inner wall of the washing tub and filtering out debris of washing water. The lint filter comprises a filter frame fixed to the inner wall of the washing tub, and a filter body being disposed in the front of the filter frame and filtering out debris of washing water, and a filter cover being combined with the filter frame and the filter body as a tightly coupled single body and being detachable only from the filter frame while tightly coupled with the filter body.

In the present invention, the filter cover is connected the filter frame by a hook and is fixed to the filter body by a press fit.

In the present invention, a protrusion is formed on either of the filter cover and the filter body, and a protrusion press-fit groove where the protrusion is pressed to fit is formed on the other.

In the present invention, a plurality of hooks are formed at either of the filter cover and the filter frame, and hook holes to which the hooks are combined are formed at the other.

In the present invention, the filter cover includes a first hook connected to the filter frame by hook connection and a second hook connected to the filter body by hook connection.

In the present invention, wherein protrusion is formed on either of the first hook and the filter body and a protrusion press-fit groove where the protrusion is pressed to fit is formed on the other.

In the present invention, the filter body includes a hook penetration path through which the first hook penetrates and protrusion is formed on the inner wall of the hook penetration path for inserting to a protrusion press-fit groove formed at the first hook In the present invention, the filter body includes a supporting rib is protruded for supporting the fastened state of the second hook.

In the present invention, the filter body comprises a lower filter including a lower side entrance to allow washing water rotating along circumferential direction of the washing tub to flow in through the side and filtering out debris of washing water flowed in through the lower side entrance; and an upper filter disposed in the upper side of the lower filter, connected to open into the lower filter in a vertical direction, allowing washing water rising from the lower filter to flow in when rising water flows are generated by the rotation of the washing tub, and forming a collecting space for collecting debris of the washing water. The filter cover disposed in the front of the upper filter and forming a discharge hole in front thereof for discharging washing water.

A method for controlling a laundry treatment machine according to the present invention comprises forming washing water flows circulating in vertical direction by rotating a washing tub in one direction for washing fabric; and forming filtering water flows flowing in circumferential direction along the inner wall of the washing tub by rotating the washing tub in clockwise and counter-clockwise direction alternately so as to flow in through the side entrance of a lint filter installed in the inner wall of the washing tub.

In the present invention, further comprises untwisting of fabric by rotating a pulsator in clockwise and counter-clockwise direction alternately; and repeating the forming of the washing water flows, the untwisting of fabric, and the forming of the filtering water flows sequentially.

In the present invention, further comprises untwisting of fabric by rotating a pulsator in clockwise and counter-clockwise direction; and after the forming of washing water flows is repeated for the first predetermined number of times, repeating the untwisting of fabric and the forming of filtering water flows sequentially for the second predetermined number of times.

In the present invention, during the forming of filtering water flows, a rotation speed of a washing tub is set lower than that during the forming of washing water flows.

Since a lint filter in a laundry treatment machine according to the present invention includes a lower filter for filtering out debris of washing water and an upper filter for collecting debris as well as filtering out foreign substances of washing water flowed in from the lower filter, filtering effect is improved as filtering is performed two times. In addition, since debris is collected in the upper filter, recontamination by debris can be prevented and cleaning of a lint filter can be simplified.

Also, since a laundry treatment machine according to the present invention prevents washing water flowed into a lint filter from flowing back to a washing tub by a check valve, recontamination of washing water and fabric can be avoided.

In addition, since in a laundry treatment machine according to the present invention, washing water flows in through the side of a lint filter so that washing water flowing in circumferential direction of a washing tub can be flowed into the lint filter during rotation of a washing tub. Therefore, a large amount of washing water can pass through the lint filter, filtering efficiency can be improved.

Moreover, since in a laundry treatment machine according to the present invention, an upper filter and a lower filter are connected by a connection path and as washing water and debris in the lower filter move to the upper filter at the time rising water flows of washing water are generated, debris can be collected inside the upper filter, debris can be collected by using rising flows of washing water.

Furthermore, since in a laundry treatment machine according to the present invention, a filter cover is combined with a filter frame and a filter body as a tightly coupled single body, and the filter cover is detached only from the filter frame while tightly coupled with the filter body, attaching and detaching is made simple and cleaning thereof can be simplified.

Besides, since a method of controlling a laundry treatment machine according to the present invention can increase the amount of washing water flowing in through the side entrance of a lint filter by rotating a washing tub in clockwise and counter-clockwise direction alternately and making washing water flow along the inner wall of the washing tub, filtering efficiency can be improved.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

In what follows, as an embodiment of a laundry treatment machine according to the present invention, a top-loading type laundry treatment machine (hereinafter, it is called a 'laundry treatment machine') will be described in detail with appended drawings.

Figure 1:
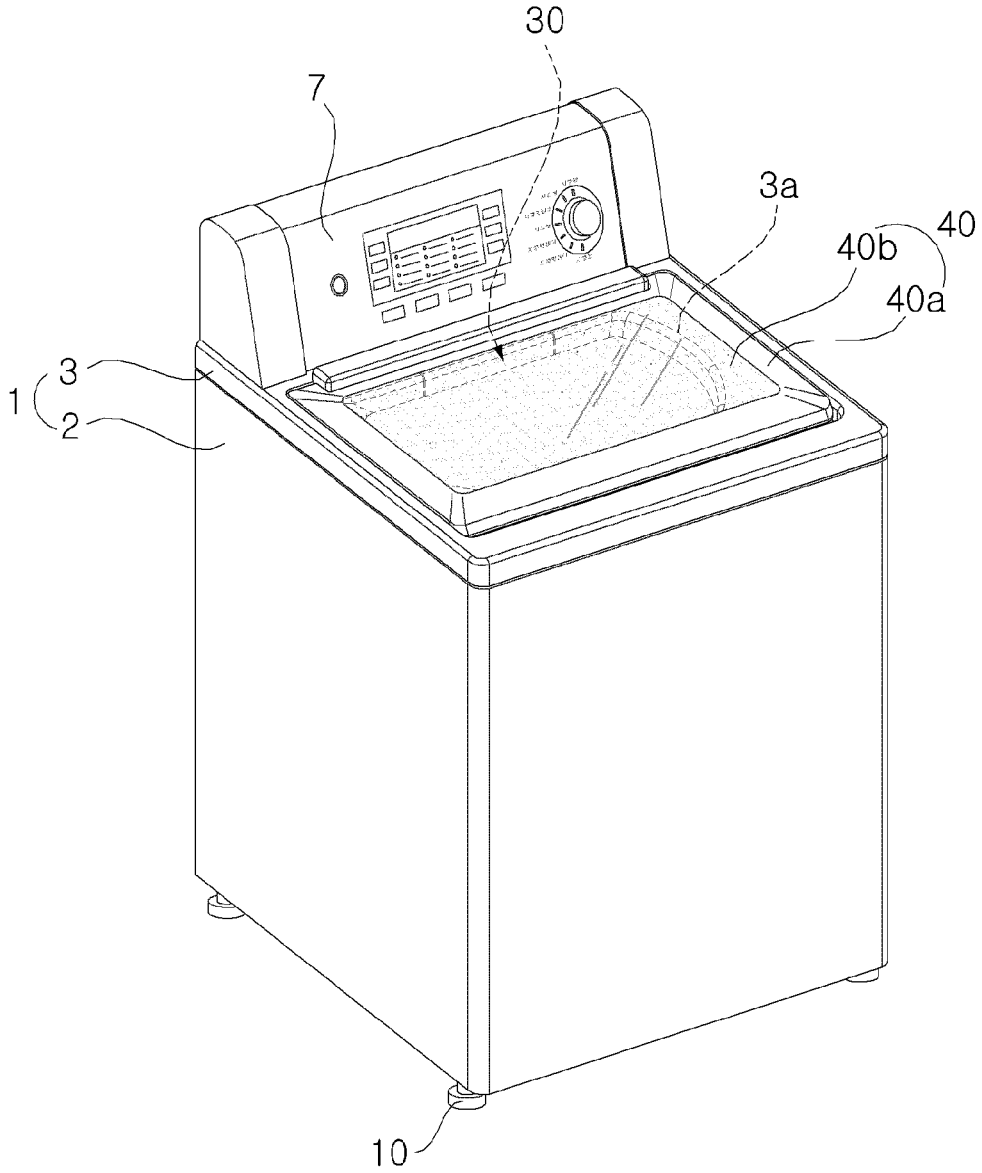
FIG. 1 illustrates a perspective view of a top-loading type laundry treatment machine according to the present invention.
Figure 2:
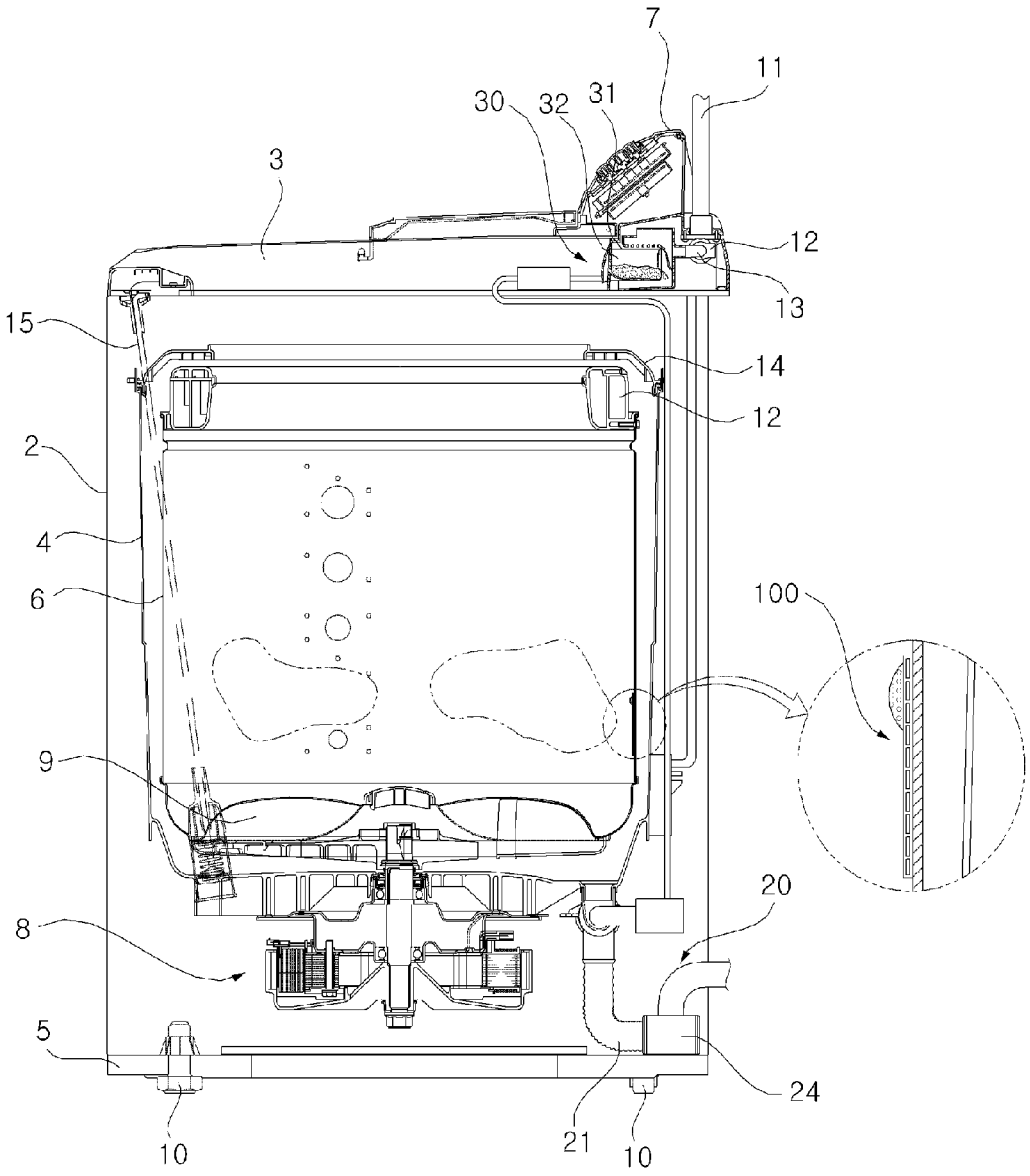
FIG. 2 illustrates a cross sectional view of a laundry treatment machine of FIG. 1.

FIG. 1 illustrates a perspective view of a top-loading type laundry treatment machine according to the present invention and FIG. 2 illustrates a cross sectional view of a laundry treatment machine of FIG. 1.

With reference to FIGS. 1 and 2, a laundry treatment machine comprises a case 1 forming an external appearance and a leg assembly 10 connected to the bottom of the case 1.

The case 1 comprises a cabinet 2 having an opening in the upper and the bottom surface, thus forming the side of a laundry treatment machine; a top cover 3 installed to cover the open top surface of the cabinet 2; and a base 5 installed at the open bottom surface of the cabinet 2.

In the cabinet 2, disposed are an outer tub 2 storing water; a washing tub 6 disposed inside the outer tub 4 and receiving laundry; a driving apparatus such as a motor driving the washing tub 6; a water supply assembly supplying water into the outer tub 4; and a drain assembly 20 draining away water inside the outer tub 4 after completion of washing or spin-drying.

Also, the case 1 further comprises a detergent supply unit 30 disposed in the top cover 3 and storing detergent temporarily. The detergent supply unit 30 is so formed to be connected to the water supply assembly and to provide detergent to the inside of the washing tub 6 with supplied water.

A fabric entrance hole 3A through which fabric is put in and taken out is formed on the top cover 3. At the top cover 3, a door 40 to open or close the fabric entrance hole 3A is installed. At least a part of the door 40 can be made of glass so that the inside can be seen. In other words, the door 40 includes a frame unit 40A and a glass unit 40B inserted in the frame unit 40A.

Also, at one side of the top cover 3, a display panel 7 to input operational commands or to display operational status of a laundry treatment machine is installed.

The outer tub 4 is disposed to be hung by a plurality of suspension 15 at the inner upper part of the cabinet 2. Part of the suspension 15 can be connected to the inner upper part of the cabinet 2 and the other part to the lower part of the outer tub 4.

In the bottom surface of the washing tub 6, a pulsator 9 to form rotating flows of water stored in the outer tub 4 is installed. The pulsator 9 can be combined with the washing tub 6 so that the washing tub 6 and the pulsator 9 rotate together when the motor 8 rotates. Equivalently, the pulsator 9 is formed separately from the washing tub 6 so that the pulsator 9 rotates independently when the motor 8 rotates.

A balancer 12 is installed in the upper side of the washing tub 6 to prevent the washing tub 6 from losing balance due to crowding of fabric into one place. A liquid balancer the inside of which is filled with liquid such as salt water can be used for the balancer 12.

On the top of the outer tub 4, a tub cover 14 is installed to prevent departure of fabric or dispersion of water.

The tub cover 14 is installed to cover the upper space between the outer tub 4 and the washing tub 6.

When the washing tub 6 rotates, washing water which passed the side wall of the washing tub 6 by centrifugal force ascends to the tub cover 14 along the space between the outer tub 4 and the washing tub 6 and flows inside the washing tub 6 after running into the tub cover 14.

The water supply assembly comprises an external hose 11 guiding water supplied from an external tap or the like to the laundry treatment machine; a water supply valve 12 connected to the external hose 11 and controlling water supply; and a water supply hose 13 connecting the water supply valve 12 and the detergent supply unit 30. The water supply valve 12 and the water supply hose 13 form a water supply path through which water is supplied.

The detergent supply unit 30 is disposed in the middle of the water supply path. The detergent supply unit 30 comprises a detergent box housing 31 installed to be connected to the water supply hose 13; a detergent box 32 which can be loaded to and unloaded from the detergent box housing 31; and a detergent box cover spraying water while fixed to the detergent box housing 31 and disposed on the top surface of the detergent box 32.

The detergent box 32 is connected to the detergent box housing 31 to be taken out from the detergent box housing 31 by a user to put detergent thereto. The detergent box 32 can be so connected to the detergent box housing 31 that sliding is allowed in the forward and backward direction. At least a part of a rear surface of the detergent box 32 is open and thus, when water is supplied, detergent can flow into the detergent box housing 31 through the rear surface of the detergent box 32 together with water.

A draining assembly 20 comprises a first draining hose 21 connected to a drain 26 formed on the bottom surface of the outer tub 4, a draining pump housing 24 including a draining pump which pumps water, a second draining hose 25 which is connected to the draining pump housing 24 and drains water pumped by the draining pump to the outside of the cabinet 2. A draining motor to drive the draining pump is disposed inside the draining pump housing 24.

The draining assembly 20 can be disposed between the outer tub 4 and the base 5.

Figure 3:
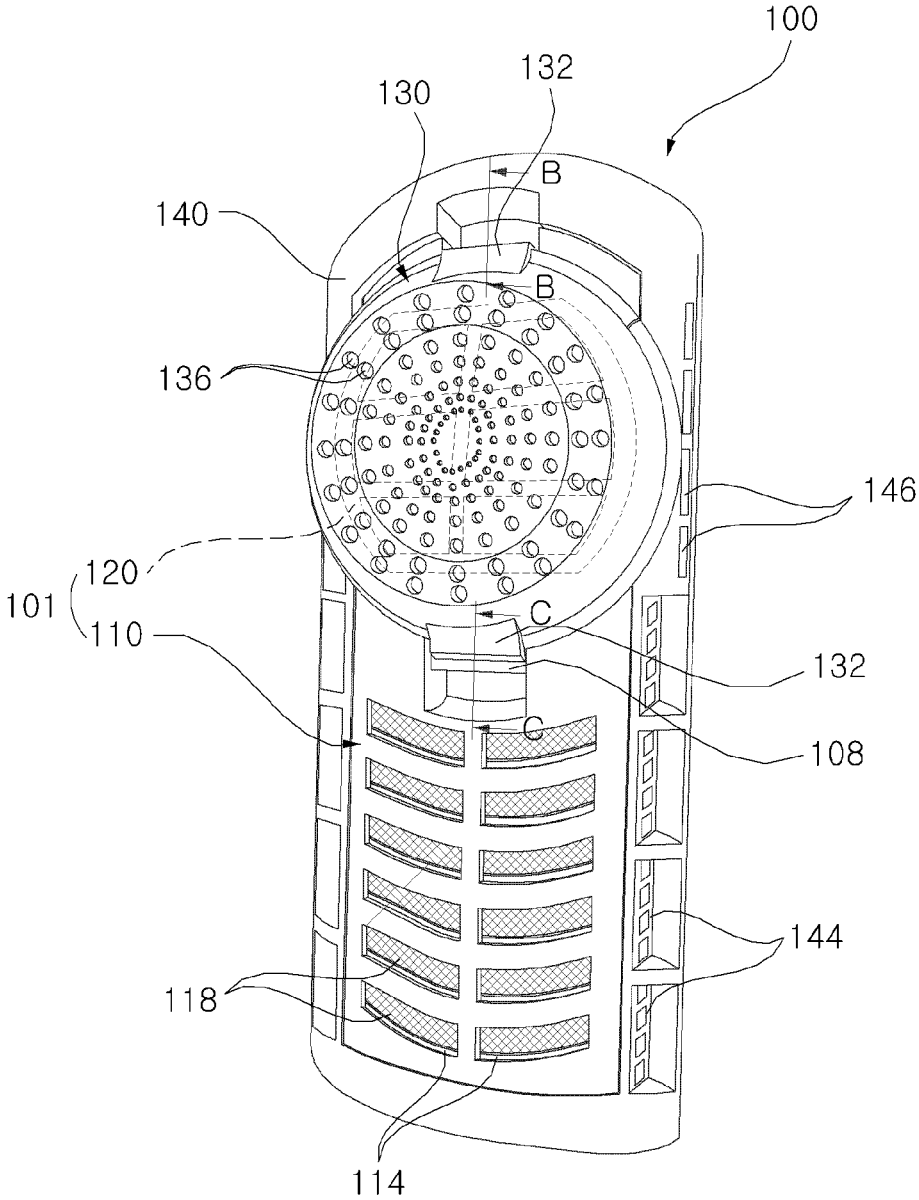
FIG. 3 illustrates a perspective view of a lint filter according to the present invention.
Figure 4:
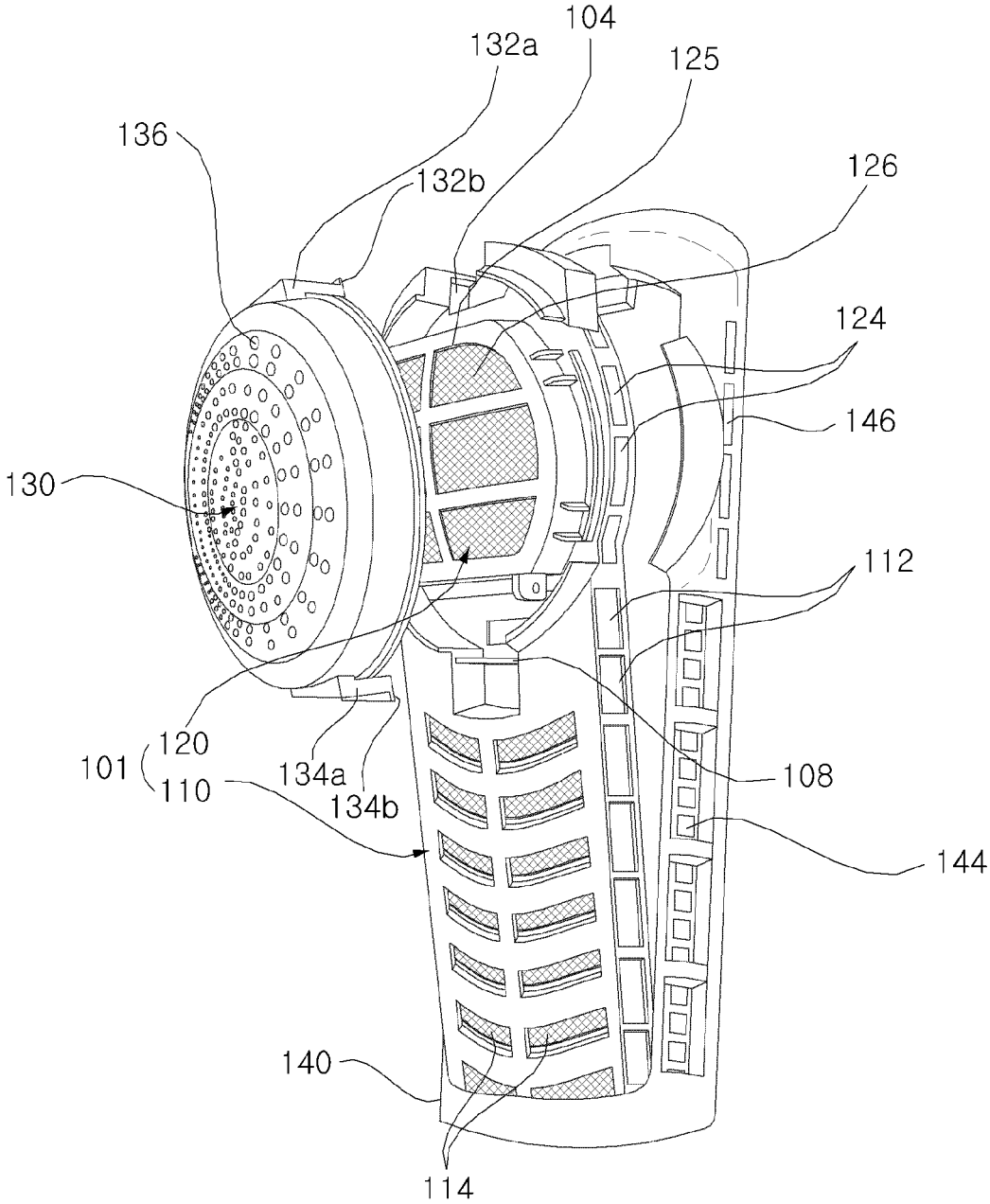
FIG. 4 illustrates a perspective view of a disassembled lint filter according to the present invention.

FIG. 3 illustrates a perspective view of a lint filter according to the present invention and FIG. 4 illustrates a perspective view of a disassembled lint filter according to the present invention.

With reference to FIG. 3, a lint filter 100 is installed in the washing tub 6 to filter out debris such as seams or lint from washing water during washing or rinsing.

The lint filter 100 can be installed in the lower part of the inner wall of the washing tub 6. Although a single lint filter is assumed to be installed in the flow description, a plurality of lint filters can also be installed at regular intervals along the periphery of the washing tub 6.

The lint filter 100 can be connected directly to the surface of the inner wall of the washing tub 6; alternatively, the lint filter 100 can be inserted to a separate space such as a flow path formed to accommodate the lint filter 100. Hereinafter, it is assumed that the lint filter 100 is positioned to the grooves formed in the surface of the inner wall of the washing tub 6 and fixed by separate connecting elements.

With reference to FIG. 4, the lint filter 100 comprises a filter body 101; a filter frame 140 supporting the filter body 101 and being fixed in the inner surface of the washing tub 6; and a filter cover 130 disposed in the front of the filter body 101.

Figure 5:
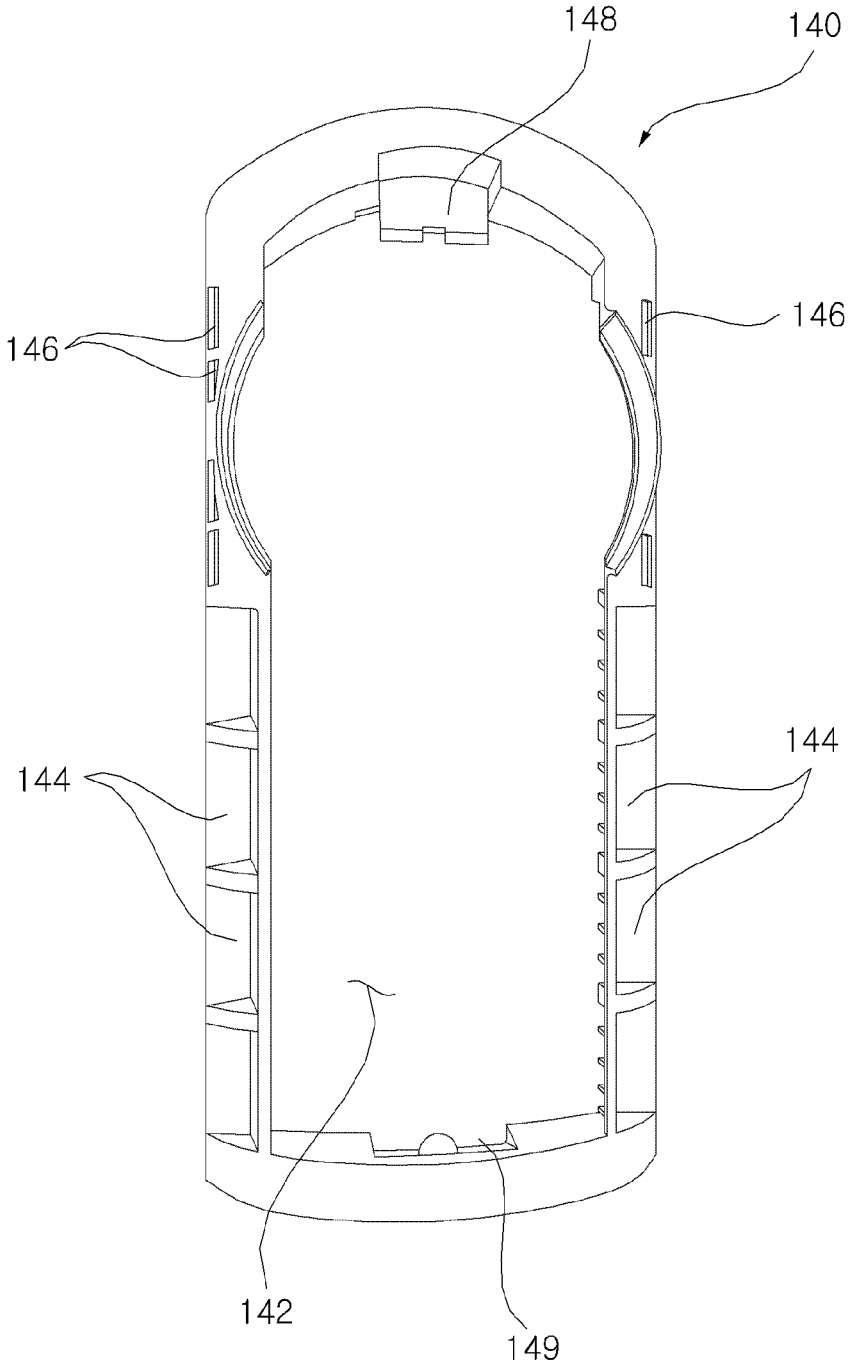
FIG. 5 illustrates a perspective view of a filter frame of FIG. 3.
Figure 6:
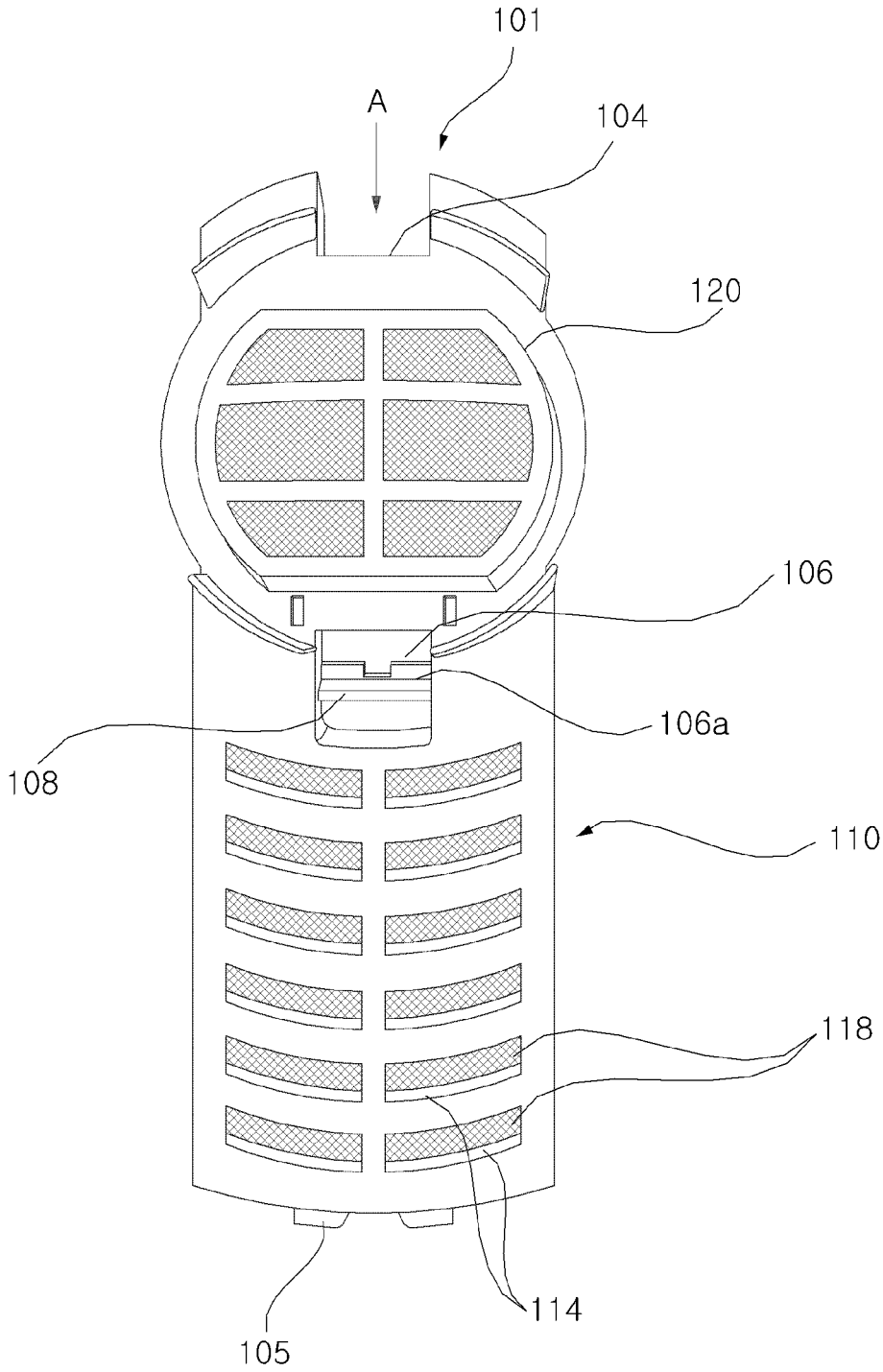
FIG. 6 illustrates a perspective view of a filter body of FIG. 3.
Figure 7:
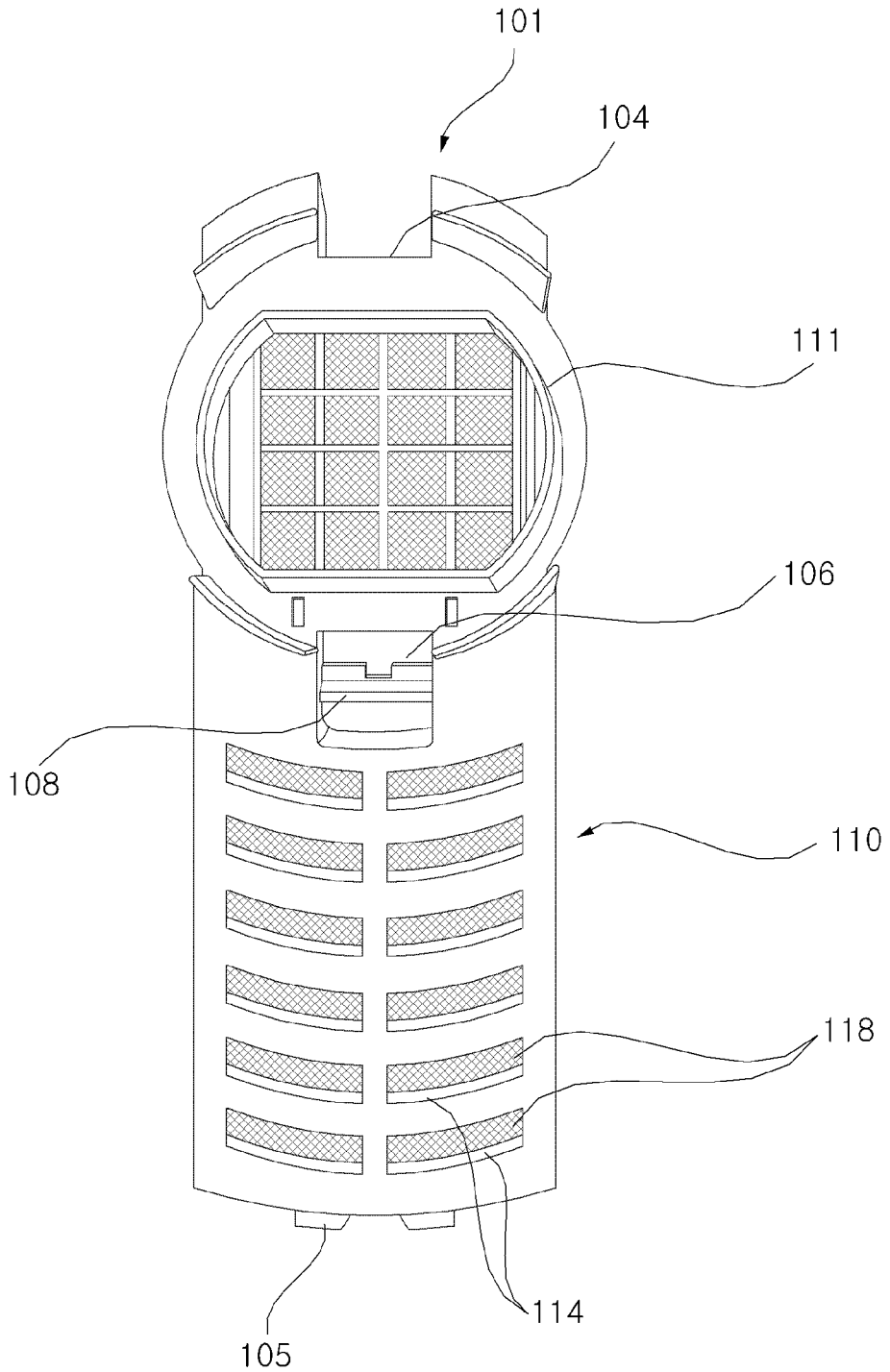
FIG. 7 illustrates a perspective view of a filter body of FIG. 6 before an upper filter is attached.
Figure 8:
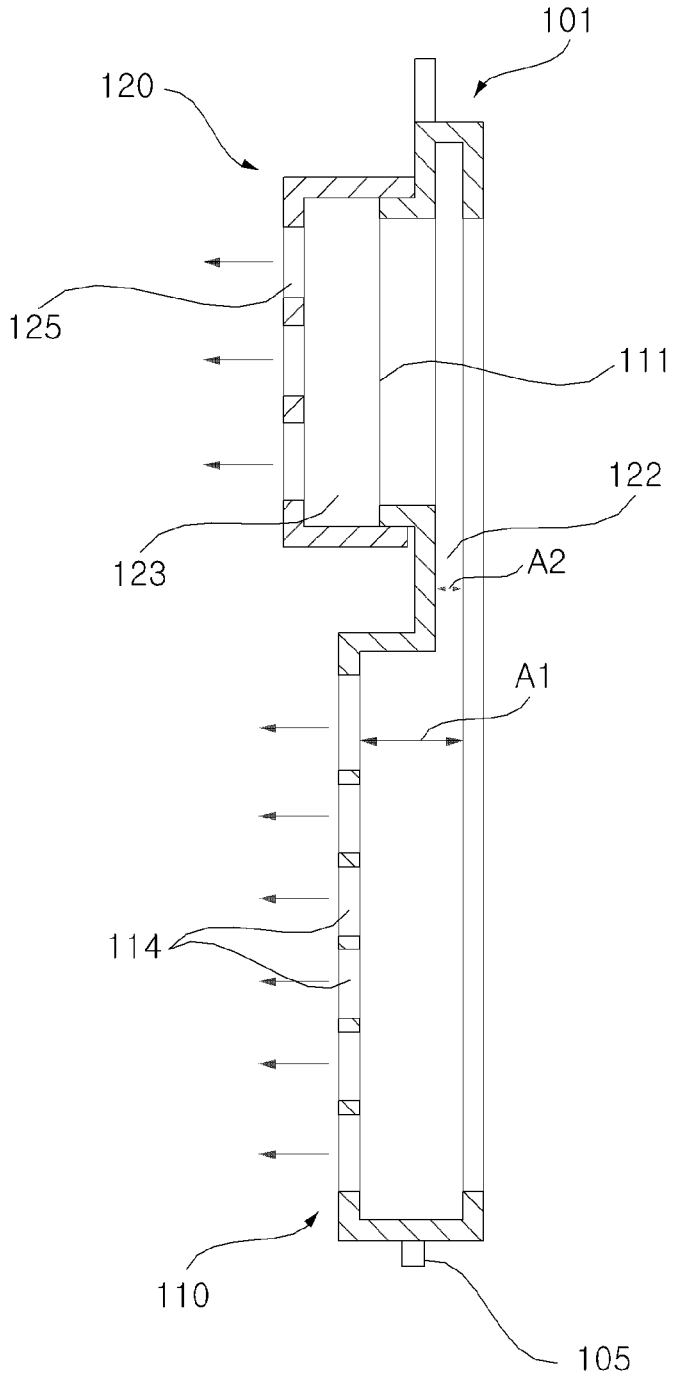
FIG. 8 illustrates a cross sectional view of a filter body of FIG. 6.

FIG. 5 illustrates a perspective view of a filter frame of FIG. 3. FIG. 6 illustrates a perspective view of a filter body of FIG. 3. FIG. 7 illustrates a perspective view of a filter body of FIG. 6 before an upper filter is attached. FIG. 8 illustrates a cross sectional view of a filter body of FIG. 6;

With reference to FIGS. 6 to 9, the filter body 101 is made long in vertical direction. The filter body 101 comprises a lower filter 110 being disposed in the lower part to filter out debris inside washing water; and an upper filter 120 being combined to an upper filter mounting hole 111 formed in the upper part and forming a space for collecting debris.

With reference to FIGS. 3 and 4, a lower side entrance 112 is formed in the side of the lower filter 110 to allow washing water rotating in circumferential direction of the washing tub 6 to flow in through the side. In the front of the lower filter 110, a lower front discharging unit 114 is formed to allow washing water to be discharged where debris of the washing water have been filtered out inside the lower filter 110.

The lower side entrance 112 is formed on the left and right side of the lower filter 110 respectively and comprised of a plurality of holes formed at regular intervals in vertical direction.

Figure 9:
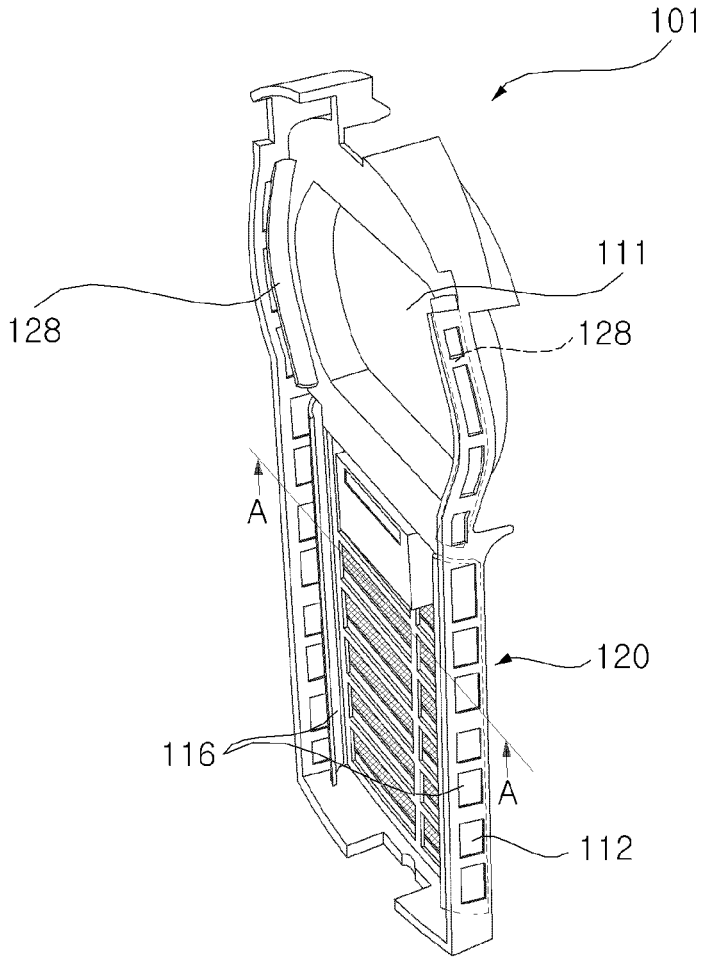
FIG. 9 illustrates a rear surface of a filter body of FIG. 6.
Figure 10:
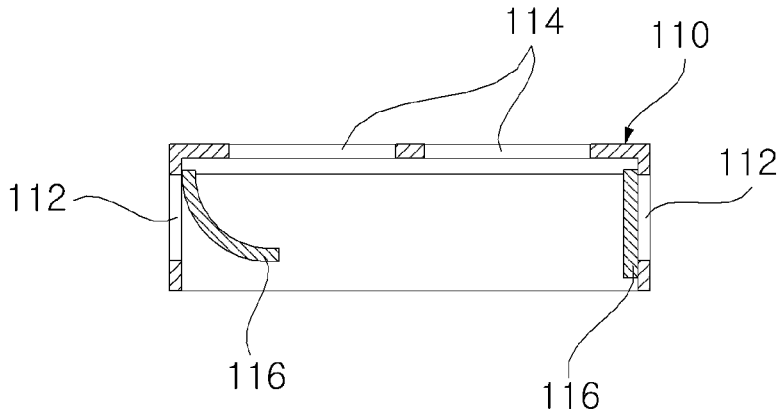
FIG. 10 illustrates a cross sectional view of a rear surface of a filter body cut along A-A line of FIG. 9.

FIG. 9 illustrates a rear surface of a filter body of FIG. 6. FIG. 10 illustrates a cross sectional view of a rear surface of a filter body cut along A-A line of FIG. 9.

With reference to FIGS. 9 and 10, a check valve 116 is installed at the lower side entrance 112 to prevent washing water flowed into the lower filter 110 from flowing backward to the outside.

A plurality of the lower filter check valve 116 can be installed at the lower side entrance 112 and at the same time, a single lower filter check valve can be used to cover or shield a plurality of the lower side entrance 112 at one time. In what follows, in the present embodiment, the lower filter check valve 116 is assumed to be formed by a single one, made long in vertical direction. The lower filter check valve 116 can assume a rectangular panel shape which is longer in vertical direction.

The lower filter check valve 116 is installed at the lower side entrance 112 to be opened and closed in lateral direction.

The lower filter check valve 116 is installed to be opened only in the inner direction of the lower filter 110 due to the pressure of washing water flowing in through the lower side entrance 112. Since the lower filter check valve 116 is disposed in the left and right side of the lower filter 110 respectively, either of the two can be selectively opened according to the direction of the flows of washing water.

The lower filter check valve 116 can be made of elastic material to be opened by the pressure of washing water flowing in through the lower side entrance 112. For example, the lower filter check valve 116 can be made of rubber or silicon.

The upper and the lower part of the lower filter check valve 116 can be connected to the upper and the lower part of the lower side entrance 112 to be able to rotate. In other words, in the upper and the lower part of the lower filter check valve 116, hinge protrusion is formed to be combined with the lower side entrance 112 by hinge structure and the hinge protrusion can be made of elastic material such as rubber.

With reference to FIG. 6, the lower front discharging unit 114 is a plurality of holes arranged to be long in the left and right direction on the front surface and disposed at regular intervals in the left and right, forward and backward direction. At the lower front discharging unit 114, a lower filter mesh 118 is installed.

With reference to FIGS. 6 to 9, the upper filter 120 is mounted to the upper filter mounting hole 111.

The upper filter 120 is disposed at the upper part of the lower filter 110 to be connected to the lower filter in a vertical direction. In other words, a connecting part 122 is formed between the upper filter 120 and the lower filter 110 to allow washing water inside the lower filter 110 to flow into the upper filter 120 when washing water forms rising water flows due to high speed rotation of the washing tub 6.

The connecting part is a path formed between the upper filter 120 and the lower filter 110. At least a part of the connecting part 122 can have a reduced part cross sectional area of which is smaller than that of the remaining part. In other words, part of the connecting part 122 can have a smaller cross sectional area; at the same time, the whole of the connecting part 122 can have a smaller cross sectional area than that of the lower filter 110.

With reference to FIG. 7, the connecting part 122 is formed to have a short step at the lower filter 120; and the cross sectional area A2 of the connecting part 122 is made smaller than that A1 of the lower filter 110. Since width of the connecting part 122 is narrower than that of the lower filter 110, running speed of flows inside the connecting part 122 becomes fast. Therefore, when rising water flows (also known as 'alpha water flow') due to the rotation of a washing tub are generated, flowing of washing water into the upper filter 120 through the connecting part 122 is facilitated.

Inside the upper filter 120, a collecting space 123 is formed to collect debris inside washing water flowed into the connecting part 122.

With reference to FIG. 8, the upper filter 120 is formed to protrude more to the front from which washing water is drained than the lower filter 110. Therefore, the collecting space 123 can be formed inside the upper filter 120.

The upper filter 120 further comprises an upper side entrance 124 formed to allow washing water to flow into the upper filter 120 rotating in circumferential direction of the washing tub.

The upper side entrance 124 can be formed either on the side of the upper filter 120 or on the side of the filter body 101. In what follows, in the present embodiment, the upper side entrance 124 is assumed to be formed on the side of the filter body 101.

The upper side entrance 124 can be formed to have a smaller area than that of the lower side entrance 112. In other words, a large amount of washing water is flowed in through the lower side entrance 112 and filtered out inside the lower filter 110. Since a small amount of washing water is flowed in through the upper side entrance 124, by minimizing the flow of washing water in the collecting space 123 inside the upper filter 120, flow of debris collected in the collecting space 123 can be kept to a minimum.

An upper check valve 128 can be disposed at the upper side entrance 124, the upper check valve 128 being installed to be opened and closed in lateral direction and thus preventing washing water flowed into the upper filter 120 from flowing backward to the outside.

Figure 11:
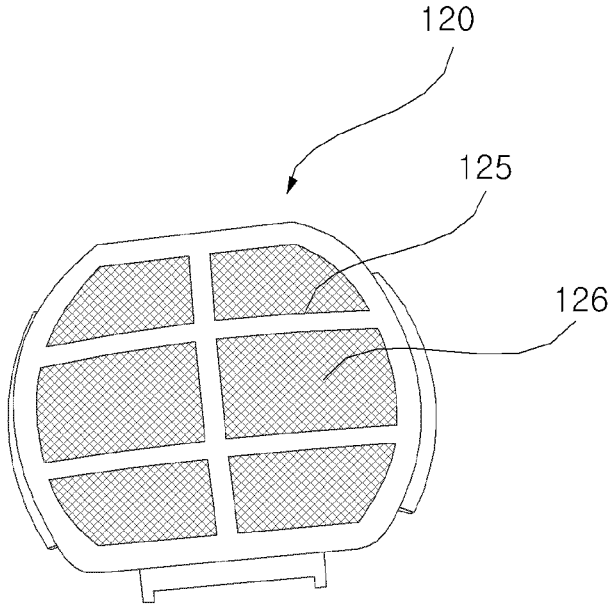
FIG. 11 illustrates a perspective view of an upper filter of FIG. 4.

FIG. 11 illustrates a perspective view of an upper filter of FIG. 4.

With reference to FIG. 11, an upper front discharging unit 125 from which washing water is discharged is formed in the front of the upper filter 120. The upper front discharging unit 125 is a plurality of holes disposed at regular intervals in the left and right, upward and downward direction in the front of the upper filter 120. An upper filter mesh 126 is disposed in the upper front discharging unit 125.

A mesh hole of the upper filter mesh 126 can be formed to be smaller than the mesh hole of the lower filter mesh 118. The mesh hole 126 of the upper filter mesh 126 can have a circular shape and the mesh hole of the lower filter mesh 118 can have a rectangular shape. Since the mesh hole of the upper filter mesh 126 is formed to be smaller than the mesh hole of the lower filter mesh 118, discharging of debris collected in the collecting space of the upper filter 120 can be minimized.

With reference to FIGS. 3 to 5, a positioning hole 142 is formed in the filter frame 140 for the filter body 101 to be safely positioned. In the left and right lower part of the filter frame 140, a frame lower entrance 144 is formed respectively to be connected to the lower side entrance 112; a frame upper entrance 146 is formed respectively in the left and right upper part of the filter frame 140 to be connected to the upper side entrance 124.

With reference to FIGS. 5 and 6, a connecting hole 149 can be formed in the lower part of the filter frame 140 where a connecting protrusion 105 formed in the lower part of the filter body 101 to be inserted.

As shown in FIG. 4, the filter cover 130 is disposed in the front of the upper filter 120. The filter cover 130 can have a circular shape to correspond to the shape of the upper filter 120.

In the front of the filter cover 130, a plurality of filter cover discharging holes 136 are formed to allow washing water discharged from the upper filter 120 to be discharged. Each of the filter cover discharging holes 136 has a circular shape and a plurality thereof can be disposed in radial direction.

The filter cover 130 is combined with the filter frame 140 and the filter body 101 as a tightly coupled single body and at the time of cleaning, is detached from the filter frame 140 while tightly couple with the filter body 101.

The filter cover 130 can be connected to the filter frame 140 by hook connection and to the filter body 101 by press-fit or hook connection; one side of the filter cover 130 can be connected to the filter frame 140 by hook connection while the other side is connected to the filter body 101 by hook connection. In what follows, in the present embodiment, description is limited to the case where the upper part of the filter cover 130 is connected to the filter frame 140 by hook connection and the lower part to the filter body 101 by hook connection.

Figure 12:
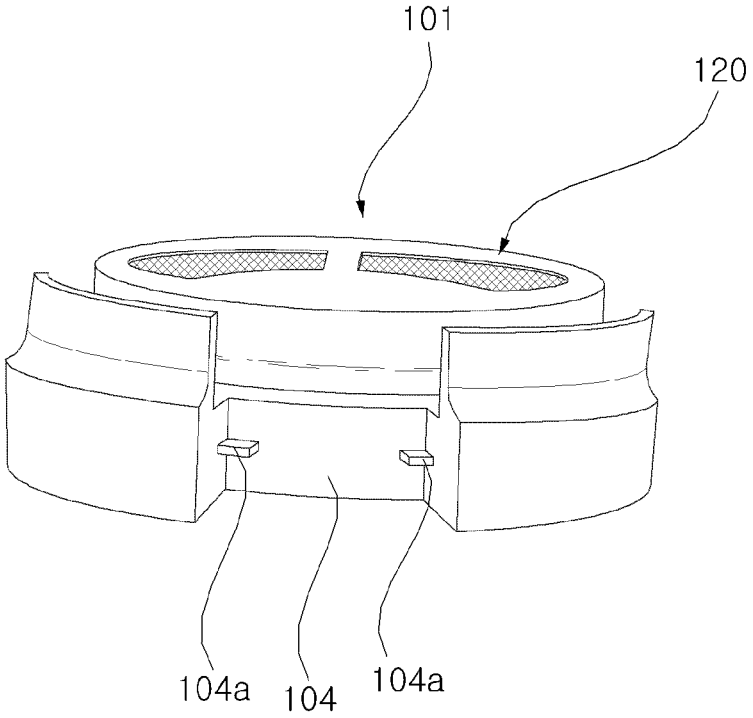
FIG. 12 illustrates a filter body seen in the A direction of FIG. 6.
Figure 13:
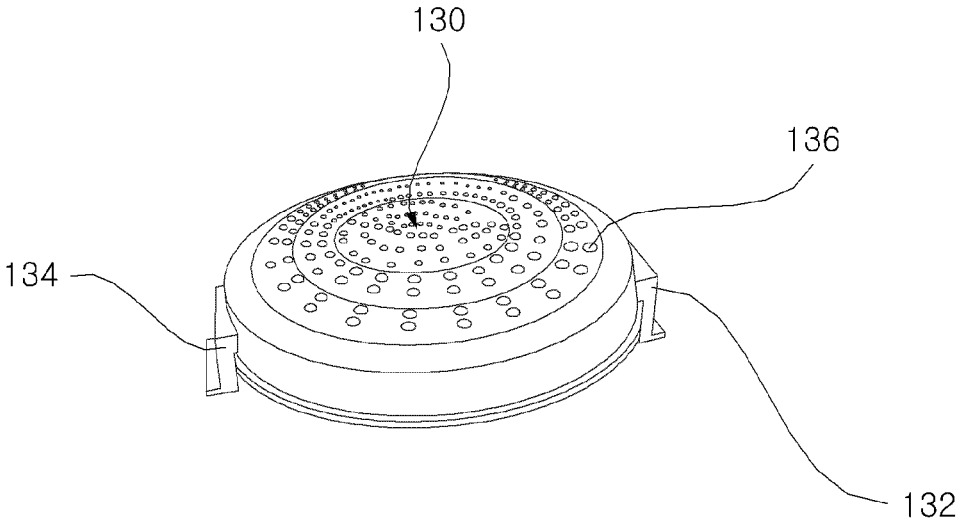
FIG. 13 illustrates a perspective view of a filter cover of FIG. 4.
Figure 14:
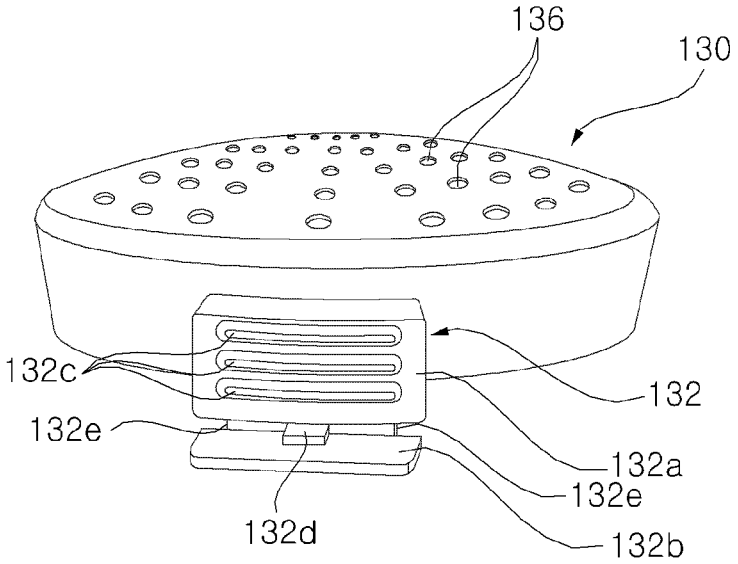
FIG. 14 illustrates a side view of a filter cover of FIG. 13.
Figure 15:
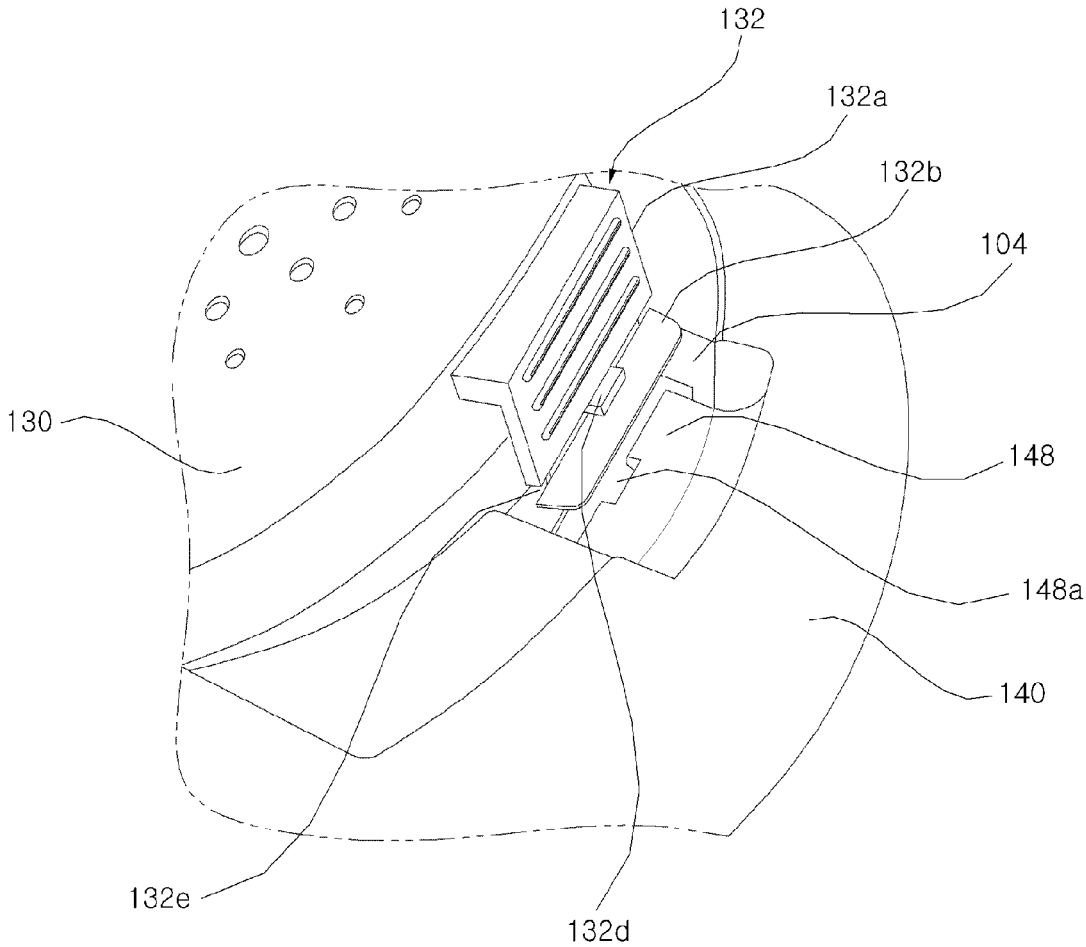
FIG. 15 illustrates a filter cover according to an embodiment of the present invention before the filter cover is combined with a filter body and a filter frame.
Figure 16:
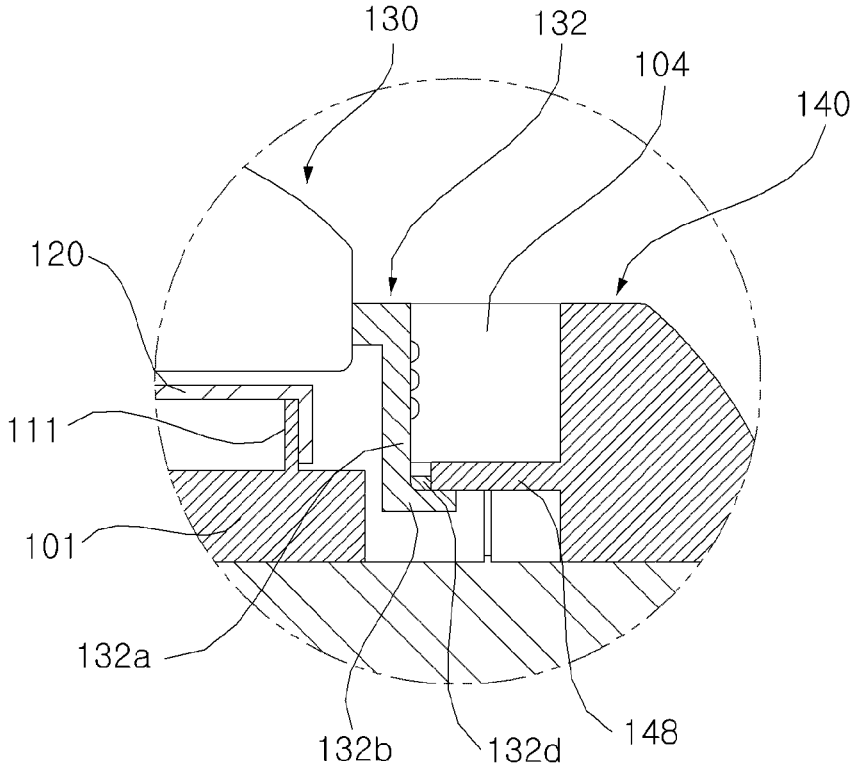
FIG. 16 illustrates a cross sectional view of a lint filter cut along B-B line of FIG. 3.
Figure 17:
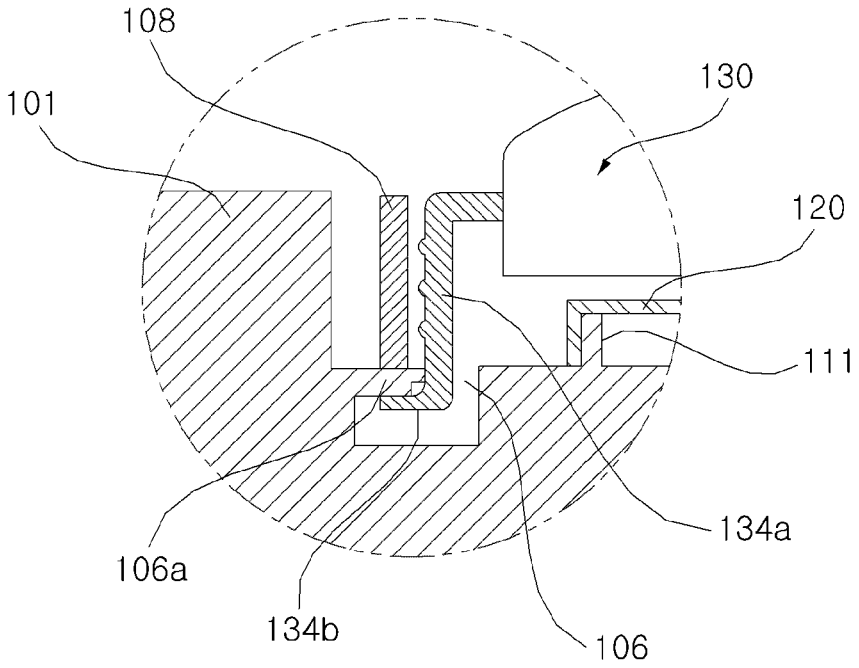
FIG. 17 illustrates a cross sectional view of a lint filter cut along C-C line of FIG. 3.

FIG. 12 illustrates a filter body seen in the A direction of FIG. 6; FIG. 13 illustrates a perspective view of a filter cover of FIG. 4; FIG. 14 illustrates a side view of a filter cover of FIG. 13; FIG. 15 illustrates a filter cover according to an embodiment of the present invention before the filter cover is combined with a filter body and a filter frame; FIG. 16 illustrates a cross sectional view of a lint filter cut along B-B line of FIG. 3; and FIG. 17 illustrates a cross sectional view of a lint filter cut along C-C line of FIG. 3;

With reference to FIGS. 13 and 14, a first hook 132 connected to the upper side of the filter frame 140 by hook connection and a second hook 134 connected to the filter body 101 by hook connection are formed in the filter cover 130.

With reference to FIGS. 14 to 17, the first and the second hook 132, 134 respectively comprise a pushing part 132A, 134A bent in downward direction and formed to allow the user to push by his or her finger; and a fitting part 132B, 134B formed to protrude in outward direction from a short part of the pushing part 132A, 134A and fitted to a first hook catching part 148 or a second hook hole 106 described below.

The pushing part 132A, 134A can be formed to have elasticity against the user's pushing action. The pushing part 132A, 134A can have a plurality of anti-skid protrusions to prevent skidding when the user takes hold thereof.

With reference to FIGS. 5, 15, and 16, a first hook catching part 148 where the first hook 132 is connected by hook connection is formed in the upper side of the filter frame 140. The hook catching part 148 is formed to protrude to the inside from the upper side of the inner periphery of the body positioning hole 142. A fitting hole 148A can be formed in the first hook catching part 148 for a fitting protrusion 132D formed between a pushing part 132A and a fitting part 132B of the first hook 132 to be fitted to the fitting hole 148A.

Meanwhile, the first hook 132, at the time of hook connection to the filter frame 140, is fixed to the filter body 101 by a press-fit.

In other words, a protrusion for press-fitting is formed in either of the first hook 132 and the filter body 101 and a protrusion press-fit groove into which the protrusion is pressed to fit is formed in the remaining one. In what follows, in the present embodiment, it is assumed that a protrusion press-fit groove 132E is formed in the first hook 132 and a protrusion 104E described below is formed in the filter body 101.

With reference to FIG. 12, a hook penetrating part 104 through which the first hook 132 penetrates is formed in the filter body 101. The hook penetrating part 104 is disposed to correspond to a first hook catching part 148 of the filter frame 140.

The protrusion 104A protruding in lateral direction is formed in the inner left and right surface of the hook penetrating part 104. The protrusion 104A is pressed to fit to a protrusion press-fit groove 132E (see FIG. 14) formed in both sides of the first hook 132.

As described above, the first hook 132 is connected to the upper side of the filter body 101 and the upper side of the filter frame 140.

Meanwhile, the second hook 134 is connected to the central part of the filter body 101 by hook connection.

With reference to FIG. 6, in the central part of the filter body 101, a second hook hole 106 where the second hook 134 is connected by hook connection is formed. The second hook 134 is hooked by a second hook catching part 106A after connected to the second hook hope 106.

A supporting rib 108 is formed being protruded in the second hook catching part 106A, the supporting rib 108 supporting the state where the second hook 134 is connected to the second hook hole 106.

With reference to FIGS. 3 and 17, the supporting rib 108 is formed to be protruded with a shape corresponding to the second hook 134 inserted to the second hook hole 106. Since the supporting rib 108 covers the second hook 134 after the second hook 134 is connected, the pushing part 134A of the second hook 134 is prevented from being pushed by some external force.

In other words, since only the first hook 132 is allowed to be removed from the filter frame 140 and hook connection between the filter cover 130 and the filter body 101 should be maintained at the time of attaching and detaching the filter cover 130, releasing due to pushing the pushing part 134A of the second hook 134 is prevented.

A method of assembling and cleaning a lint filter according to an embodiment of the present invention as constituted above will now be described.

The lint filter 100 can be installed on the inner wall of the washing tub 6 while the filter frame 140, the filter body 101, and the filter cover 130 are assembled; equivalently, the remaining parts can be installed after the filter frame 140 is installed on the inner wall of the washing tub 6.

The filter frame 140 can be fixed to the lower inner wall of the washing tub 6 by using a separate connection element.

The filter body 101 is disposed in the front of the filter frame 140.

With reference to FIGS. 5 and 6, the filter body 101 can be connected if the filter body 101 is pushed to the filter frame 140 after the connecting protrusion 105 of the filter body 101 is fitted to a connection hole 149 formed in the lower side of the filter frame 140.

Hereinafter, with reference to FIG. 4, the filter cover 130 is disposed in the front of the upper filter 120. The first hook 132 of the filter cover 130 is connected to the filter frame 140 through the hook penetrating part 104 of the filter body 101. Also, the second hook 134 is connected to the filter body 101.

In other word, with reference to FIGS. 15 and 16, if the user releases pushing after fitting the fitting part 132B of the first hook 132 to the hook penetrating part 104 while pushing the first hook 132, the fitting part 132B of the first hook 132 is hooked by the first hook catching part 148, thus completing hook connection. At this time, the protrusion 104A is pressed to fit to the protrusion press-fit groove 132E of the first hook 132 and thus, the first hook 132 is fixed.

Also, when the first hook 132 is fitted to the hook penetrating part 104, the protrusion 104A of the filter body 101 is pressed to fit to the protrusion press-fit groove 132E of the first hook 132. Therefore, the first hook 132 being connected to the filter body 101, the filter cover 130 can be connected to the filter body 101 as well as the filter frame 140 as a single body.

Meanwhile, the second hook 134, after being fitted to the second hook hole 106 while being pushed elastically by the user's pushing, is connected to the second hook catching part 106A by hook connection upon release of the pushing. Since the pushing part 134A of the second hook 134 becomes to face the supporting rib 108 after the second hook 134 is connected by hook connection, the second hook 134 can be prevented from being pushed by external force. Therefore, the hook connection of the second hook 134 can be firmly maintained.

Therefore, when the user tries to clean the lint filter 101, he or she can remove the first hook 132 from the filter frame 140 by pushing the pushing part 132A of the first hook 132. If the pushing part 132A is pushed, the first hook 132 can be released from the first hook catching part 148.

At this time, since the protrusion press-fit groove 132E of the first hook 132 and the protrusion of the filter body 101 still stay connected together, the filter cover 130 can remain fastened to the filter body 101.

As described above, if the filter cover 130 is pull to the front while the first hook 132 being held, the filter body 101 starts to decline with a predetermined angle from the filter frame 140 and therefore, the lower part of the filter body 101 can also be removed from the lower side of the filter frame 140.

Accordingly, the filter cover 130 and the filter body 101 can be removed from the filter frame 140. In other words, the filter body 101 can be easily removed while the filter frame 140 fixed to the inner wall of the washing tub 6 left intact.

Therefore, since the filter body 101 and the filter cover 130 can be removed from the filter frame 140, removal and cleaning thereof can be made simple.

Operations of a lint filter according to an embodiment of the present invention as constituted above will now be described.

When the laundry treatment machine operates, if either of the washing tub 6 and the pulsator 9 starts to rotate due to the actuation of the motor 8, rotating water flows flowing in circumferential direction of the washing tub 6 are formed inside the washing tub 6.

Water pressure of the rotating water flows pushes the lower check valve 116 to the inside of the lower filter 110 and pushes the upper check valve 128 to the inside of the upper filter 120.

Therefore, the lower check valve 116 and the upper check valve 128 are opened, washing water flows into the lower side entrance 112 and the upper side entrance 124, respectively.

Debris of washing water flowed into the lower side entrance 112 are filtered out through the lower mesh 118. Part of washing water with filtered out debris is discharged into the inside of the washing tub through the lower front discharging unit 114.

Meanwhile, washing water turns toward the inner wall of the washing tub 6 due to centrifugal force from high speed rotation of the washing tub 6 and ascends to the upper side of the washing tub 6. Such water flows of a laundry treatment machine are called washing water flow, circulating water flow or alpha water flow. In what follows, the water flows are called alpha water flow.

When the alpha water flows are generated, washing water and debris inside the lower filter 110 moves to the upper filter 120 through the connecting part 122. At this time, width of the connecting part is narrower than that of the other part, running speed of washing water is getting fast and rising of washing water and debris becomes easy.

Debris flowed into the inside of the upper filter 120 through the connecting part 122 are filtered out from the upper mesh 126 and washing water with debris filtered out is discharged to the inside of the washing tub 6 through the upper front discharging part 125.

Debris filtered out at the upper mesh 126 gather in the collecting space 123. Since the upper filter 120 forms the collecting space 123 by protruding in the forward direction, the upper filter 120 not only filters out but also collects debris.

Therefore, debris are filtered out inside the lower filter 110; and debris filtered out and part of washing water move to the upper filter 120 and can be collected inside the upper filter 120.

Next, the lint filter 120 is removed for cleaning by pulling the hook 132 of the filter cover 130. At the time of removal of the filter cover 130, the filter body 101 is detached from the filter frame 140; therefore, cleaning of the lower filter 120 and the upper filter 130 becomes easy.

Meanwhile, at the time of stopping the motor 8, termination of washing course, or draining course, water pressure of washing water flowing into the lint filter 120 diminishes or disappears.

As the lower check valve 116 and the upper check valve 128 return to their original position, flowing of washing water or debris remaining inside the lint filter 120 backward through the lower side entrance 112 and the upper side entrance 124 can be prevented.

Figure 18:
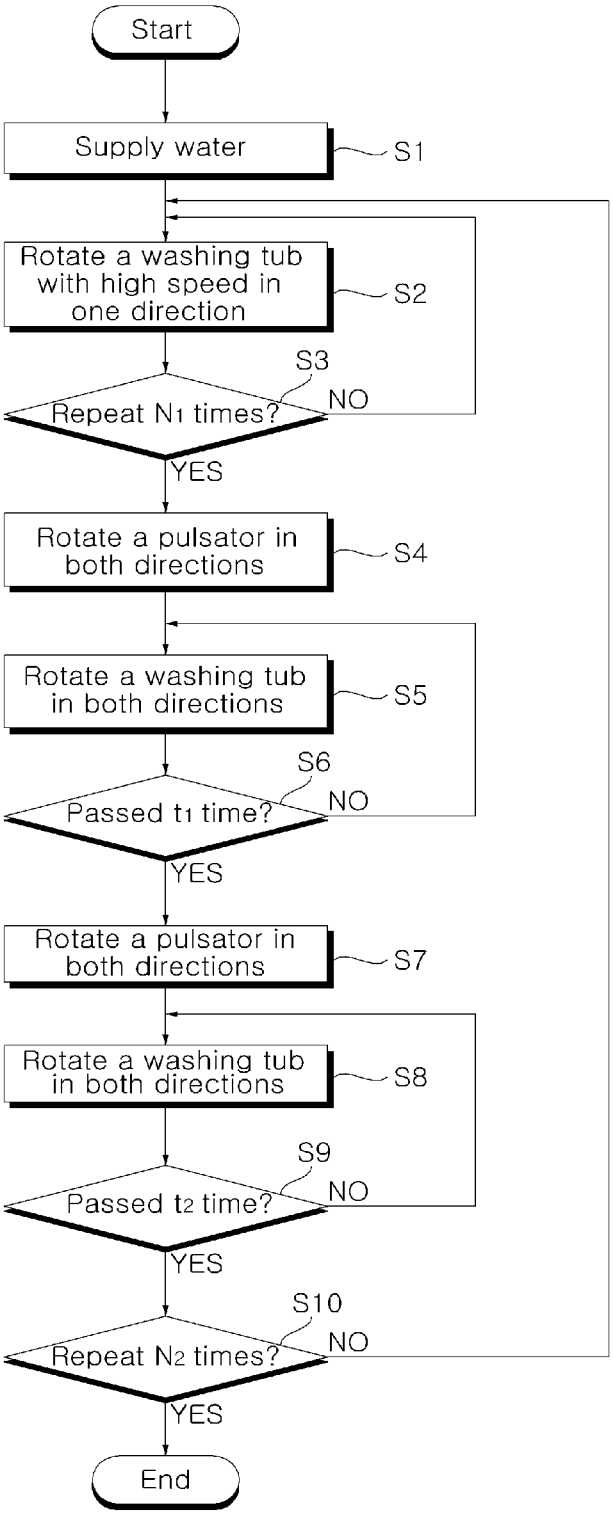
FIG. 18 illustrates a flowchart of a method for controlling a laundry treatment machine according to an embodiment of the present invention.

FIG. 18 illustrates a flowchart of a method for controlling a laundry treatment machine according to an embodiment of the present invention.

With reference to FIG. 18, a method for controlling a laundry treatment machine according to an embodiment of the present invention is described below.

Power is applied to a laundry treatment machine, an amount of fabric is detected, and water is supplied to a predetermined level in proportion to the detected amount of fabric S1.

After completion of water supply, a controller performs forming washing water flows where the controller rotates the washing tub 6 with high speed in either clockwise or counter-clockwise direction and forms washing water flows described later S2.

In the forming of washing water flows, the pulsator 9 can rotate together and it is equally possible that only the washing tub 6 rotates.

If the washing tub 6 rotates with high speed in one direction, washing water inside the washing tub 6 flows out to the outside of the washing tub 6 through a connecting hole of the washing tub 6 by centrifugal force. Washing water which flowed out ascends along the space between the washing tub 6 and the outer tub 4, flows in the direction to the tub cover 14, runs into the tub cover 14, and forms water flows flowing into the inside of the washing tub 6. In other words, water flows formed as washing water ascends to the upper side of the washing tub 6 and then descends are called washing water flow, circulating water flow or alpha water flow. By circulating washing flow in the upward and downward direction, washing of fabric can be performed effectively.

The controller performs rotating the washing tub 6 in one direction with high speed repeatedly as many times N1 as set beforehand. In the present embodiment, the predetermined number of times N1 set beforehand is assumed to be four. S3

Next, the controller performs fabric untwisting to untwist fabric by rotating the pulsator in both directions. In the fabric untwisting, the pulsator 9 is rotated alternately in clockwise and counter-clockwise direction S4.

In the fabric untwisting, the pulsator 9 can be rotated in both directions as many times as set beforehand or for predetermined time duration.

After the fabric untwisting, forming of filtering water flow is performed where filtering water flows are formed for washing water to flow into the lint filter 60 easily by rotating the washing tub 6 in both directions S5.

While the washing tub 6 is rotated in clockwise or counter-clockwise direction alternately, washing water flows along the inner wall of the washing tub 6. Since the lint filter 60 forms a side entrance including the lower side entrance 112 and the upper side entrance 124 on the left and right surface thereof, if washing water flows along the inner wall of the washing tub 6, washing water can be flowed more easily through the side entrance. Since a lot more amount of washing water can flow into the side entrance of the lint filter 60, a lot more amount of washing water is filtered out and thus, filtering efficiency can be improved.

In the forming the filtering water flows, rotation speed of the washing tub 6 can be set lower than that of the washing tub 6 at the step of forming washing water flows. Since washing water should be made to circulate in upward and downward direction at the step of forming the washing water flows, the washing tub 6 is made to rotate with relatively high speed.

On the other hand, since the forming filtering water flows only requires that washing water flows into the side entrance of the lint filter as the washing water rotates in circumferential direction along the inner wall of the washing tub 6, it is preferred to rotate the washing tub 6 with lower speed than that employed at the step of the forming washing water flows.

Also, in the forming filtering water flows, rotation speed of the washing tub 6 can be set differently according to the water level of the washing tub 6. In other words, rotation speed of the washing tub 6 can be set in proportion to the water level of the washing tub 6.

In addition, although the step of the forming filtering water flows can be performed as many times as set beforehand or for a predetermined time duration, it is assumed to be performed for a predetermined time duration t1. For example, the predetermined time duration t1 can be 60 seconds S6.

Next, the controller again performs the fabric untwisting step where the pulsator 9 is rotated in both directions S7.

Next, forming filtering water flows where the washing tub 6 is rotated in both directions is performed again for a predetermined time duration t2, S8, S9.

As described above, the forming washing water flows, fabric untwisting, and forming filtering water flows are performed sequentially; however, while the forming washing water flows is performed for once, the fabric untwisting and the forming filtering water flows can be performed two times, respectively.

In other words, forming washing water flows, fabric untwisting, forming filtering water flows, fabric untwisting, and forming filtering water flows are performed in the order of appearance; and the above procedure can be repeated as many times as set beforehand N2, S10. In the present embodiment, the predetermined number of times N2 is assumed to be two.

Figure 19:
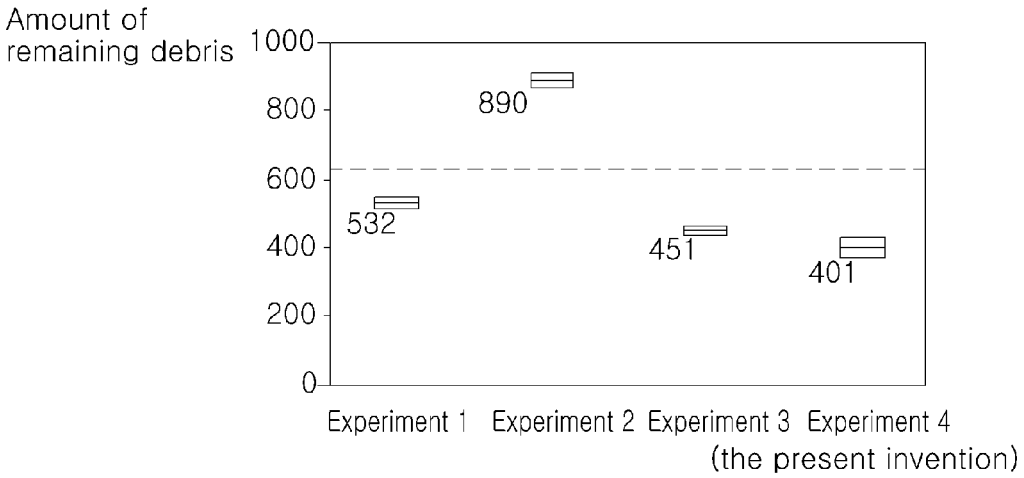
FIG. 19 is a graph showing comparative data for the measured amount of debris remaining in washing water after a washing course according to various experimental conditions.

FIG. 19 is a graph showing comparative data for the measured amount of debris remaining in washing water after a washing course according to various experimental conditions.

With reference to FIG. 19, experiment 1 corresponds to a model where a bottom surface entrance through which washing water flows is formed at the bottom of a lint filter and the entrance is equipped with a check valve; experiment 2 corresponds to a model where a bottom surface entrance through which washing water flows is formed at the bottom of a lint filter but the entrance is not equipped with a check valve. Experiment 3 corresponds to a model where a side entrance through which washing water flows is formed in the left and right side of a lint filter and the side entrance is equipped with a check valve; experiment 4 corresponds to the same model as the experiment 3 and a control method according to an embodiment of the present invention is applied.

As shown in FIG. 19, for the case of model 4 where a side entrance is formed in the side of a lint filter and filtering water flows are so formed to allow washing water to flow easily into the side entrance, the amount of remaining debris in washing water is smallest among the four experiments.

Therefore, by forming a side entrance including the lower side entrance 112 and the upper side entrance 124 in the side of the lint filter 60; and making washing water flow along the inner wall of the washing tub 6 and into the side entrance of the lint filter 60 by rotating the washing tub 6 in both directions, a lot more amount of washing water can pass the lint filter 60; thus, filtering efficiency can be improved.

It will be apparent to those skilled in the art that other specific embodiments of the invention can be made without departing from the spirit or modifying fundamental characteristics of the invention. Thus, it should be understood that the embodiments described above are provided as examples in all aspects and do not limit modifications and variations of the invention. The scope of the invention is specified by the appended claims rather than the detailed description given above. It should be interpreted that the spirit and the scope of the claims and all the modifications or variations derived from their equivalents belong to the scope of the invention.

What is claimed is:

1. A laundry treatment machine comprising:

a case comprising a fabric entrance hole on a top thereof;

a washing tub rotatably disposed inside the case; and a lint filter disposed at an inner wall of the washing tub and filtering out debris from washing water, the lint filter comprising:

a lower filter provided with a lower side entrance opened toward a circumferential direction of the washing tub allowing washing water rotating in the circumferential direction to flow into the lint filter;

an upper filter disposed at an upper side of the lower filter and communicating with the lower filter to allow washing water rising from the lower filter while the washing tub is rotating to flow into the upper filter; and a check valve configured to open or close the lower side entrance, the check valve being opened when the washing tub rotates in an opened direction of the lower side entrance and being closed when the washing tub rotates in a direction opposite to the opened direction of the lower side entrance.

2. The laundry treatment machine of claim 1, wherein a part of a connecting path communicating the upper filter and the lower filter has a reduced cross sectional area.

3. The laundry treatment machine of claim 1, wherein the upper filter discharges washing water in a radially inward direction of the washing tub and protrudes in the radially inward direction further than the lower filter.

4. The laundry treatment machine of claim 1, wherein the lint filter further comprises an upper side entrance opened toward the circumferential direction of the washing tub and allowing washing water rotating in the circumferential direction to flow into the upper filter.

5. The laundry treatment machine of claim 4, wherein the upper side entrance is smaller than the lower side entrance.

6. The laundry treatment machine of claim 1, wherein the upper filter and the lower filter each comprise a mesh part, and wherein mesh holes of the mesh part of the upper filter are formed to be smaller than mesh holes of the mesh part of the lower filter.

7. The laundry treatment machine of claim 1, further comprising a filter frame fixed at the inner wall of the washing tub and supporting the lower filter.

* * * * *